US008567285B2

(12) United States Patent
Fu

(10) Patent No.: US 8,567,285 B2
(45) Date of Patent: Oct. 29, 2013

(54) MOBILE ROBOTIC VACUUM CLEANER WITH A DETACHABLE ELECTRICAL FAN

(75) Inventor: Wanda Fu, Guangdong (CN)

(73) Assignee: Egenpower Inc., Laguna Niguel, CA (US)

( * ) Notice: Subject to any disclaimer, the term of this patent is extended or adjusted under 35 U.S.C. 154(b) by 355 days.

(21) Appl. No.: 12/954,211

(22) Filed: Nov. 24, 2010

(65) Prior Publication Data

US 2012/0085190 A1 Apr. 12, 2012

(30) Foreign Application Priority Data

Oct. 11, 2010 (CN) ..... 2010 2 0575504 U

(51) Int. Cl.
*F16H 33/00* (2006.01)

(52) U.S. Cl.
USPC ..... 74/640; 74/665

(58) Field of Classification Search
USPC ..... 74/412, 417, 421 A, 423, 640, 665 F, 74/665 G, 665 GB, 665 GC, 665 H
See application file for complete search history.

(56) References Cited

U.S. PATENT DOCUMENTS

| | | | | | |
|---|---|---|---|---|---|
| 114,754 | A | * | 5/1871 | Blatchly | 74/665 H |
| 366,125 | A | * | 7/1887 | Noyes | 74/665 GB |
| 456,957 | A | * | 8/1891 | Jones | 72/110 |
| 989,373 | A | * | 4/1911 | Lindgren | 74/665 GB |
| 1,049,056 | A | * | 12/1912 | Cunningham | 74/665 GB |
| 1,245,987 | A | * | 11/1917 | Schoonover | 74/378 |
| 2,115,975 | A | * | 5/1938 | Harrold | 101/177 |
| 2,199,659 | A | * | 5/1940 | Courville | 74/15.86 |
| 2,331,073 | A | * | 10/1943 | Harvey et al. | 416/123 |
| 2,396,781 | A | * | 3/1946 | Glynn | 192/20 |
| 2,508,411 | A | * | 5/1950 | Lundquist | 15/49.1 |
| 2,524,425 | A | * | 10/1950 | Chester | 74/665 GB |
| 3,256,746 | A | * | 6/1966 | Smith | 74/417 |
| 3,408,954 | A | * | 11/1968 | Kademann et al. | 105/34.1 |
| 3,926,072 | A | * | 12/1975 | Richardson | 57/71 |
| 3,927,436 | A | * | 12/1975 | Inoue et al. | 15/250.17 |
| 3,937,093 | A | * | 2/1976 | Johnson et al. | 74/417 |
| 3,954,083 | A | * | 5/1976 | Frostrom | 440/61 R |
| 4,044,632 | A | * | 8/1977 | Wildhaber | 74/665 G |
| 4,287,790 | A | * | 9/1981 | Fujiwara et al. | 74/665 GB |
| 4,502,347 | A | * | 3/1985 | Norris et al. | 74/417 |

(Continued)

FOREIGN PATENT DOCUMENTS

| | | | | |
|---|---|---|---|---|
| EP | 551122 | A2 | * | 7/1993 |
| JP | 56055741 | A | * | 5/1981 |
| JP | 58178038 | A | * | 10/1983 |

*Primary Examiner* — David M Fenstermacher
*Assistant Examiner* — Zakaria Elahmadi
(74) *Attorney, Agent, or Firm* — Muncy, Geissler, Olds & Lowe, PLLC

(57) ABSTRACT

A driving module installed in a base frame having a power socket is disclosed to include a casing detachably affixed to the base frame and defining therein an accommodation chamber, a motor fixedly mounted in the accommodation of the casing and having an output shaft and a power cable extended out of the casing and electrically connected to the power socket, a transmission gear set rotatable by the output shaft of the motor, a transmission shaft pivotally mounted in the casing and having a driving portion drivable by said transmission gear set to rotate the transmission shaft and at least one first toothed face, and at least one rotation shaft pivotally mounted in the casing, each rotation shaft having a second toothed face meshed with the first toothed face and rotatable by the transmission shaft.

8 Claims, 8 Drawing Sheets

(56) References Cited

U.S. PATENT DOCUMENTS

| | | | | | |
|---|---|---|---|---|---|
| 4,615,230 | A * | 10/1986 | Guichard | 74/427 |
| 4,619,162 | A * | 10/1986 | Van Laere | 81/464 |
| 4,738,332 | A * | 4/1988 | Wright | 180/197 |
| 4,771,652 | A * | 9/1988 | Zimmer | 74/640 |
| 5,363,723 | A * | 11/1994 | Hoffman | 74/606 R |
| 5,483,733 | A * | 1/1996 | Hoffman | 29/463 |
| 5,494,466 | A * | 2/1996 | Vernea | 440/75 |
| 5,501,636 | A * | 3/1996 | Janke et al. | 464/48 |
| 5,737,968 | A * | 4/1998 | Hardey et al. | 74/421 A |
| 6,105,450 | A * | 8/2000 | Sasaki et al. | 74/421 A |
| 6,324,929 | B1 * | 12/2001 | Franchini | 74/412 R |
| 6,848,531 | B2 * | 2/2005 | Izumi et al. | 180/344 |
| 2004/0103733 | A1 * | 6/2004 | Sumita et al. | 74/421 A |
| 2009/0314318 | A1 * | 12/2009 | Chang | 134/58 R |
| 2012/0142487 | A1 * | 6/2012 | Winter et al. | 475/332 |
| 2012/0173064 | A1 * | 7/2012 | Won et al. | 701/22 |
| 2012/0180254 | A1 * | 7/2012 | Morse et al. | 15/345 |
| 2012/0317745 | A1 * | 12/2012 | Jung et al. | 15/319 |

* cited by examiner

MOBILE ROBOTIC VACUUM CLEANER WITH A DETACHABLE ELECTRICAL FAN

BACKGROUND OF THE INVENTION

1. Field of the Invention

The present invention relates to mobile robotic vacuum cleaner technology and more specifically, to a driving module installed in the base frame of the mobile robotic vacuum cleaner to rotate its roller brushes.

2. Description of the Related Art

Following improvement in living standards, modern people do more care about cleaning of home environment. Further, because people are busy with work, many different mobile robotic vacuum cleaners are created to serve people. To people who raise cats, dogs or other pets at home, the help of these mobile robotic vacuum cleaners is more prominent A mobile robotic vacuum cleaner has roller brushes mounted in the base frame thereof for direct contact with the floor below the base frame to direct dirty substances to a predetermined location for vacuuming. Gears and rotating shafts are pivotally mounted in the base frame and drivable by a motor to rotate the roller brushes. After a long use, the gears may start to wear. When a gear starts to wear, it must be replaced. When replacing a damaged gear, the size of the damaged gear must be recognized. Further, the user must watch many other matters, such as the accuracy of the positioning of the gear, the accuracy of the pivoted connection between the shaft and the base frame, the application of lubricating grease, and etc. Further, the installation of the aforesaid driving mechanism complicates the assembly process of the mobile robotic vacuum cleaner and increases the chance of error. To manufacturing management, the aforesaid problems will increase the management cost.

SUMMARY OF THE INVENTION

The present invention has been accomplished under the circumstances in view. It is the main object of the present invention to provide a driving module, which facilitates the user or worker to repair or install brush rollers.

To achieve this and other objects of the present invention, a driving module is installed in a base frame having a power socket. The driving module comprises a casing detachably affixed to the base frame and defining therein an accommodation chamber, a motor fixedly mounted in the accommodation of the casing and having an output shaft and a power cable extended out of the casing and electrically connected to the power socket, a transmission gear set rotatable by the output shaft of the motor, a transmission shaft pivotally mounted in the casing and having a driving portion drivable by said transmission gear set to rotate the transmission shaft and at least one first toothed face, and at least one rotation shaft pivotally mounted in the casing, each rotation shaft having a second toothed face meshed with the first toothed face and rotatable by the transmission shaft.

Thus, the user or worker can repair or install the roller brush driving structure conveniently by means of replacing the driving module, saving much labor and time.

DETAILED DESCRIPTION OF THE INVENTION

Figure 1:
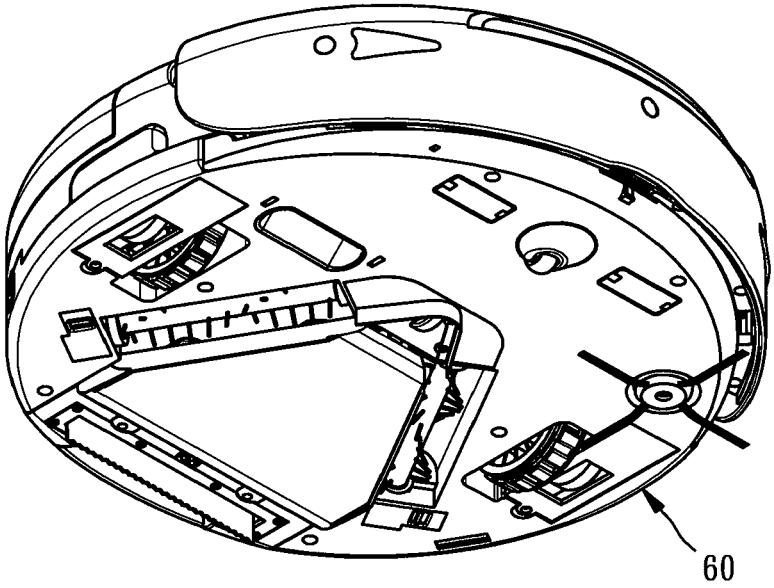
FIG. 1 is an oblique elevation illustrating a driving module installed in a base frame in accordance with the present invention.
Figure 2:
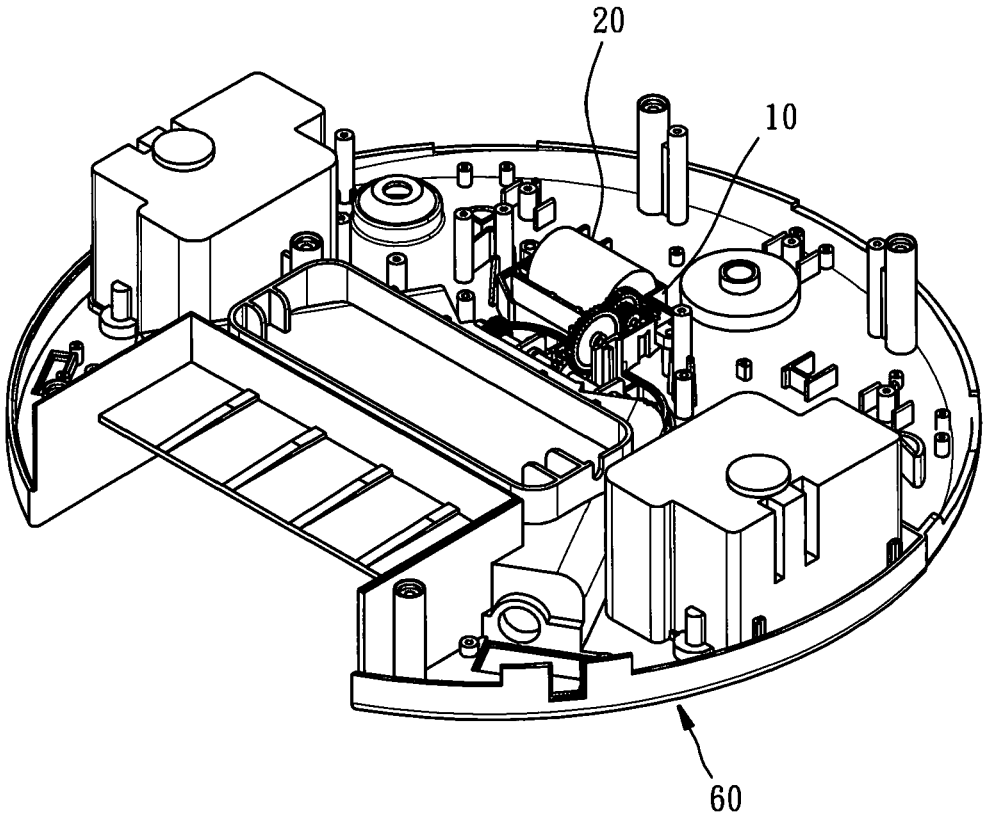
FIG. 2 is a perspective view illustrating the driving module installed in the base frame in accordance with the present invention.
Figure 3:
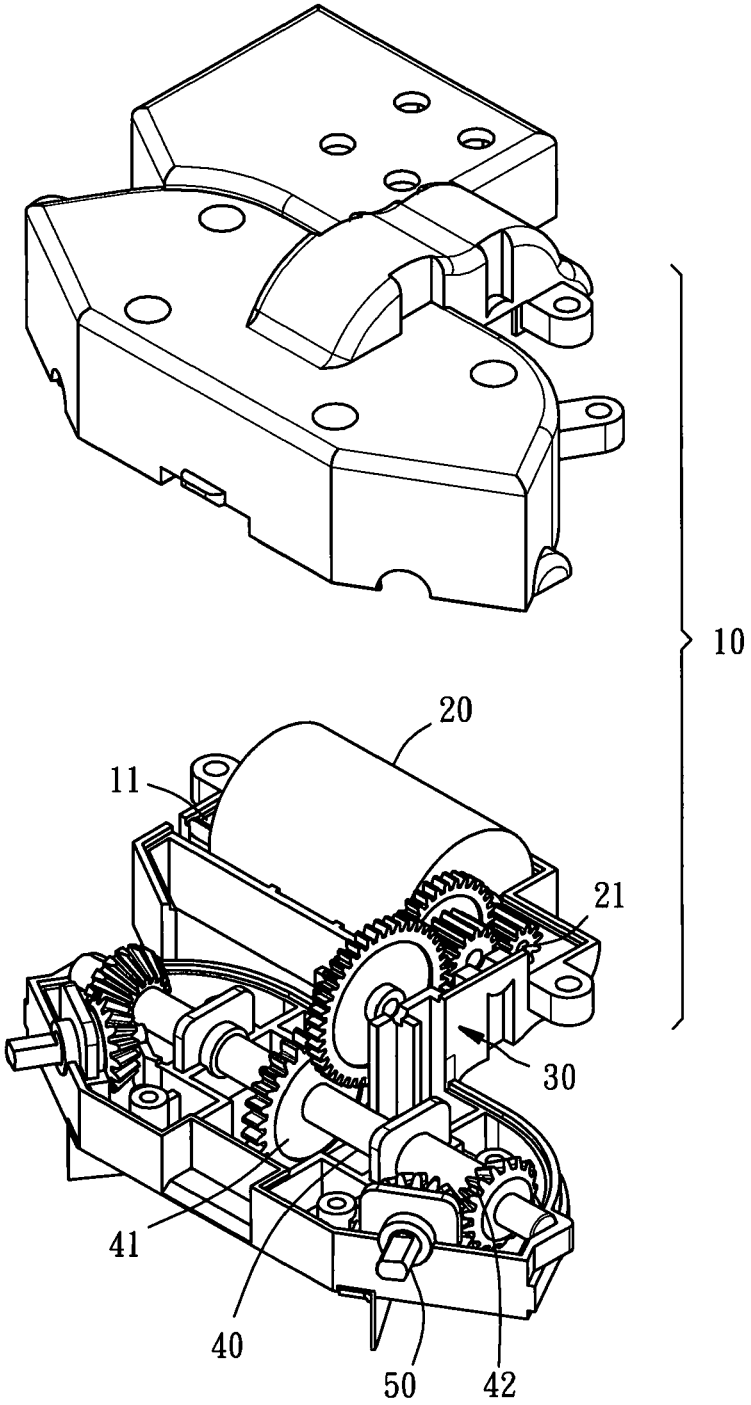
FIG. 3 is an exploded view of the driving module in accordance with the present invention.
Figure 4:
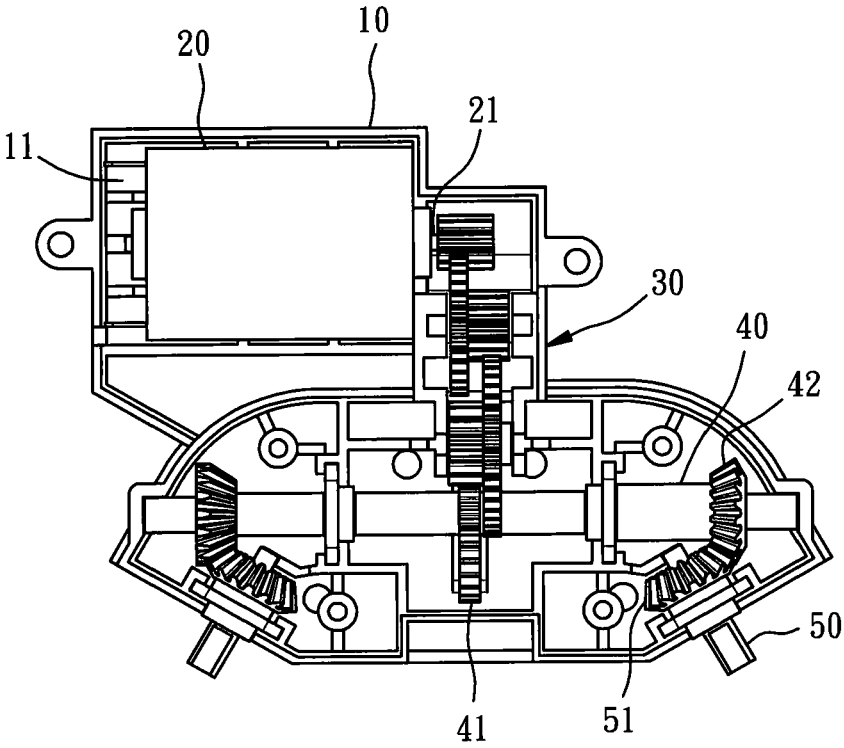
FIG. 4 is a top view of a part of the driving module in accordance with the present invention.

Referring to FIGS. 1-4, a driving module is shown installed in a base frame 60 having a power socket (not shown). The driving module comprises a casing 10, a motor 20, a transmission gear set 30, a transmission shaft 40 and at least one rotation shaft 50.

The casing 10 is detachably fastened to the base frame 60, defining therein an accommodation chamber 11.

The motor 20 is fixedly mounted in the accommodation chamber 11 inside the casing 10, having an output shaft 21 and a power cable (not shown) extending out of the casing 10 and electrically connected to the power socket.

The transmission gear set 30 is rotatable by the output shaft 21 of the motor 20 to transfer the rotary driving force of the motor 20 outwards.

The transmission shaft 40 is pivotally mounted in the casing 10, having a driving portion 41 and at least one, for example, but not limited to, two first toothed faces 42. The driving portion 41 is driven by the transmission gear set 30 to cause the transmission shaft 40 to rotate.

The number of the at least one rotation shaft 50 according to this embodiment is 2. However, the number of the at least one rotation shaft 50 can be 1. Each rotation shaft 50 is pivotally mounted in the casing 10, having one second toothed face 51 meshed with the first toothed faces 42 for enabling the respective rotation shaft 50 to be rotated by the transmission shaft 40.

Figure 5:
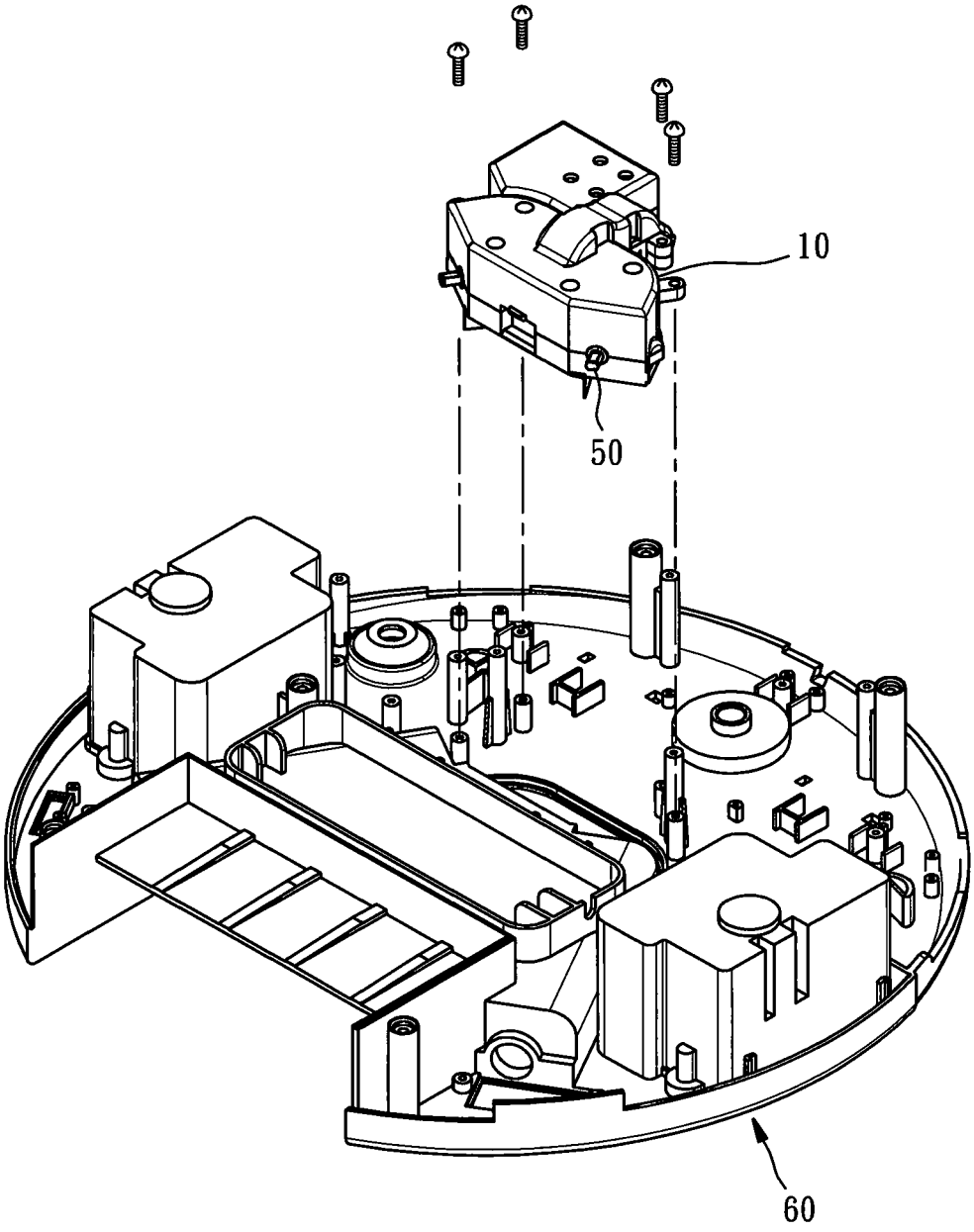
FIG. 5 is a schematic drawing illustrating the driving module separated from the base frame in accordance with the present invention.
Figure 6:
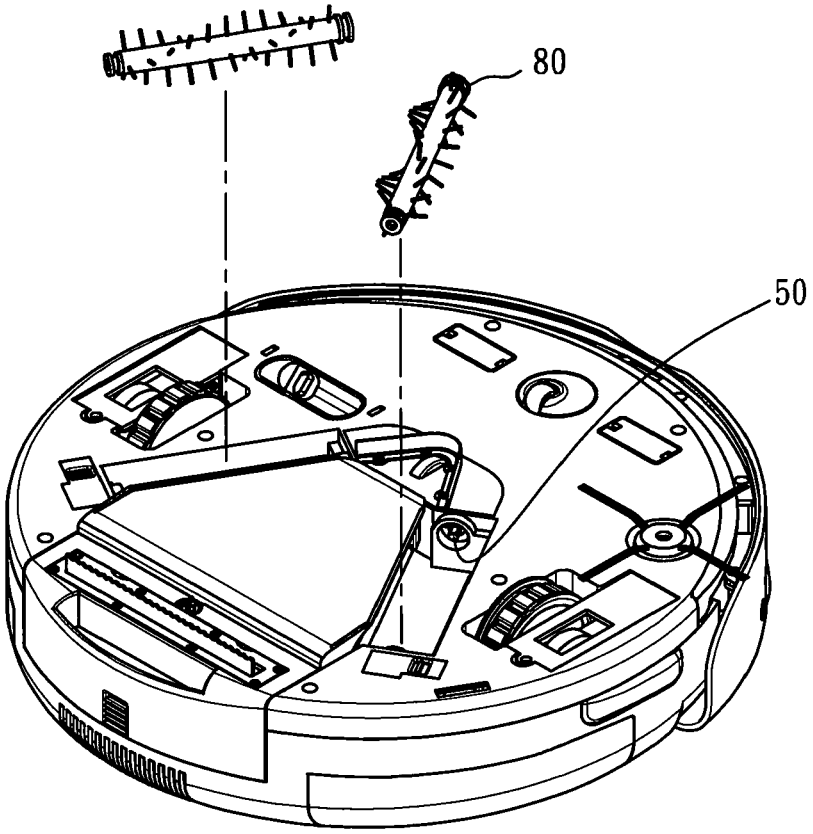
FIG. 6 is a schematic drawing of the present invention, illustrating the driving module mounted in the base frame before installation of the roller brushes.

Referring to FIGS. 5 and 6, during installation of the driving module, the casing 10 is affixed to the base frame 60 by the user or a worker, and then the power cable of the motor 20 is electrically connected to the power socket at the base frame 60, and at final, one respective roller brush 80 is connected to each rotation shaft 50. Thus, the rotary driving force of the output shaft 21 of the motor 20 can be transferred through the driving module to rotate each roller brush 80.

Thus, only by means of mounting and dismounting the driving module, the user and the worker can replace the gears and install the driving structure, avoiding the problems encountered in the prior art design.

Figure 7:
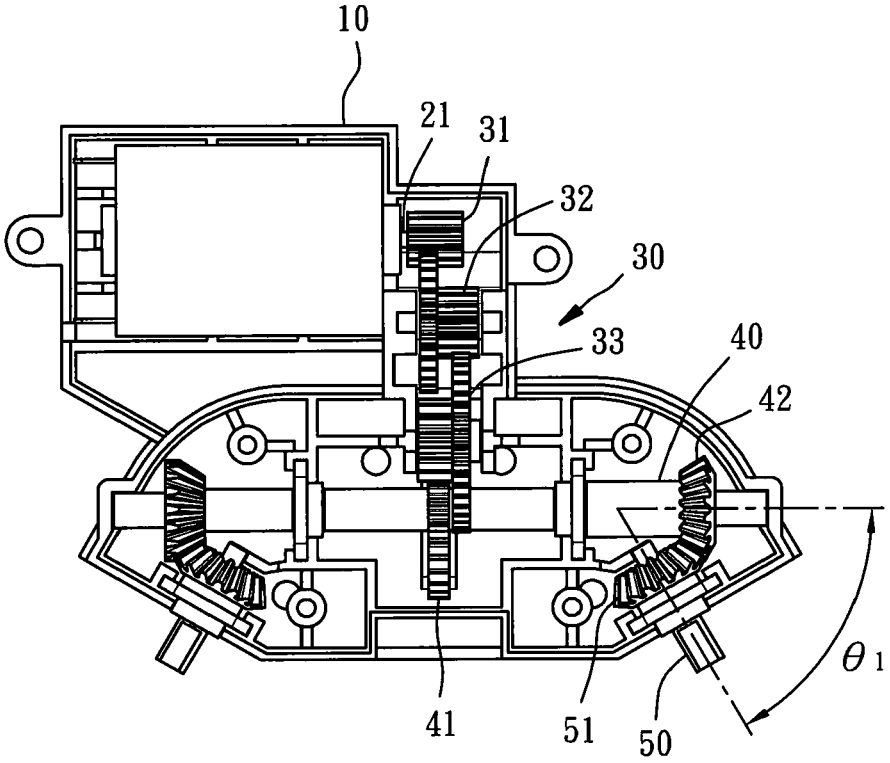
FIG. 7 is a top view of a part of the present invention, illustrating an acute contained angle $\theta_1$ defined between the transmission shaft and each rotation shaft.
Figure 8:
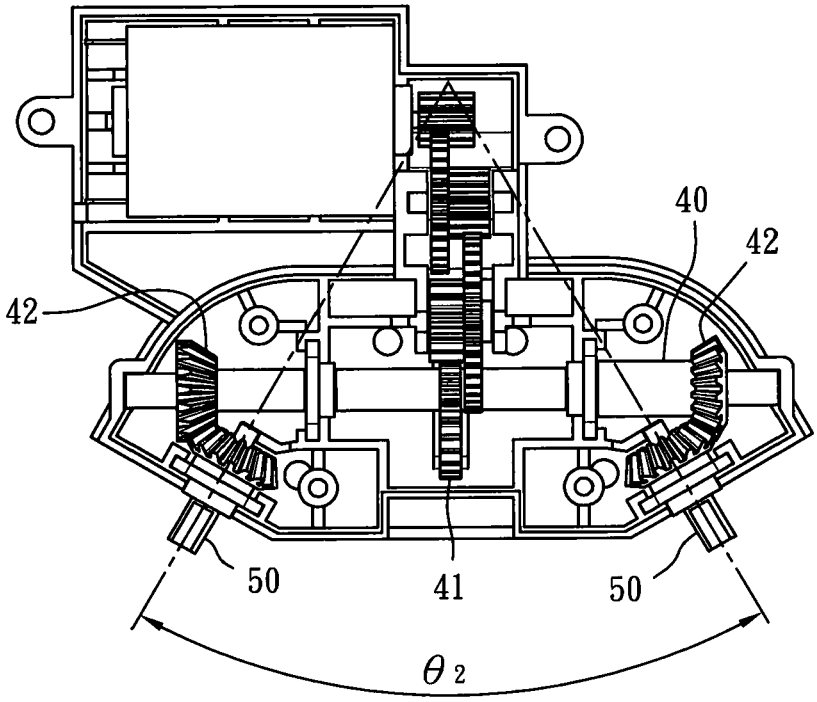
FIG. 8 is a top view of a part of the present invention, illustrating an acute contained angle $\theta_2$ defined between the rotation shafts.

Further, as shown in FIGS. 7 and 8, the transmission gear set 30 comprises a transmission gear 31, an input gear 32 and an output gear 33. The transmission gear 31 is fixedly mounted on the output shaft 21. The input gear 32 is pivotally mounted in the casing 10 and meshed with the transmission gear 31. The output gear 33 is pivotally mounted in the casing 10 and rotatable by the input gear 32. Further, the driving portion 41 is a toothed face meshed with the output gear 33.

During rotation of the output shaft 21 of the motor 20, the input gear 32 is driven by the transmission gear 31 to rotate the output gear 33. Because the driving portion 41 is meshed with the output gear 33, rotating the output gear 33 causes rotation of the transmission shaft 40.

It is to be understood that the contained angle $\theta_1$, which is defined between the transmission shaft 40 and each rotation shaft 50 is an acute angle. According to this embodiment, the $\theta_1$ is 60 degrees. Thus, the first toothed faces 42 and the second toothed face 51 are bevel gears for enabling the transmission shaft 40 to rotate the at least one rotation shaft 50.

Further, according to the present preferred embodiment, the number of the first toothed faces 42 and the number of the at least one rotation shaft 50 are 2, and the at least one rotation shaft 50 and the transmission shaft 40 are arranged at one same side. Each rotation shaft 50 is located at an opposing position and aimed at the driving portion 41. Further, a second contained angle $\theta_2$ is defined between the rotation shafts 50. The second contained angle $\theta_2$ is an acute angle. According to the present preferred embodiment, the second contained angle $\theta_2$ is 60 degrees.

Subject to the aforesaid arrangement, the user or worker can repair or install the roller brush driving structure conveniently by means of replacing the driving module, saving much labor and time.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A driving module installed in a base frame, said driving module comprising:

a casing detachably affixed to said base frame, said casing defining therein an accommodation chamber;

a motor fixedly mounted in said accommodation of said casing, said motor comprising an output shaft;

a transmission gear set rotatable by said output shaft of said motor;

a transmission shaft pivotally mounted in said casing, said transmission shaft comprising a driving portion and at least one first toothed face, said driving portion being drivable by said transmission gear set to rotate said transmission shaft; and at least one rotation shaft pivotally mounted in said casing, each said rotation shaft comprising a second toothed face meshed with said first toothed face and rotatable by said transmission shaft, wherein the number of said at least one first toothed face and the number of said at least one rotation shaft are 2, and the two rotation shafts are arranged at one same side relative to said transmission shaft.

2. The driving module as claimed in claim 1, wherein said transmission gear set comprises a transmission gear, an input gear and an output gear, said transmission gear being affixed to said output shaft, said input gear being pivotally mounted in said casing and meshed with said transmission gear, said output gear being pivotally mounted in said casing and rotatable by said input gear, said driving portion being configured subject to said output shaft and meshed with said output gear.

3. The driving module as claimed in claim 1, wherein said transmission shaft and each said rotation shaft define a first contained angle that is an acute angle.

4. The driving module as claimed in claim 3, wherein said first contained angle is 60 degrees.

5. The driving module as claimed in claim 3, wherein each said first toothed face and said second toothed face are bevel gears.

6. The driving module as claimed in claim 1, wherein each said rotation shaft is disposed at a location determined subject to the position of said driving portion.

7. The driving module as claimed in claim 1, wherein said rotation shafts define therebetween a second contained angle that is an acute angle.

8. The driving module as claimed in claim 7, wherein said second contained angle is 60 degrees.

* * * * *